US010463124B2

(12) United States Patent
Richards et al.

(10) Patent No.: US 10,463,124 B2
(45) Date of Patent: Nov. 5, 2019

(54) BACKPACK

(71) Applicant: Nomatic, LLC, Cottonwood Heights, UT (US)

(72) Inventors: Jon Richards, Salt Lake City, UT (US); Jacob Durham, Salt Lake City, UT (US)

(73) Assignee: Nomatic, LLC, Cottonwood Heights, UT (US)

( * ) Notice: Subject to any disclaimer, the term of this patent is extended or adjusted under 35 U.S.C. 154(b) by 112 days.

(21) Appl. No.: 15/851,482

(22) Filed: Dec. 21, 2017

(65) Prior Publication Data

US 2019/0191837 A1 Jun. 27, 2019

(51) Int. Cl.

| | |
|---|---|
| ***A45F 3/04*** | (2006.01) |
| ***A45C 9/00*** | (2006.01) |
| ***A45C 3/02*** | (2006.01) |
| ***A45C 7/00*** | (2006.01) |
| ***A45F 4/02*** | (2006.01) |
| *A45C 3/00* | (2006.01) |

(52) U.S. Cl.

CPC ..... *A45C 9/00* (2013.01); *A45C 3/02* (2013.01); *A45C 7/0063* (2013.01); *A45F 3/04* (2013.01); *A45F 4/02* (2013.01); *A45C 2003/008* (2013.01); *A45C 2009/007* (2013.01); *A45F 3/047* (2013.01)

(58) Field of Classification Search

CPC ..... A45C 7/0063; A45C 2003/007; A45C 2003/008; A45F 3/04; A45F 3/047

USPC ..... 224/581–583, 652

See application file for complete search history.

(56) References Cited

U.S. PATENT DOCUMENTS 3,622,056 A * 11/1971 Droeger ..... A45C 3/00 224/153
5,647,522 A * 7/1997 Routh ..... A45F 3/04 224/250
5,749,447 A * 5/1998 Hersh ..... A45C 3/00 190/111
5,749,503 A * 5/1998 Wulf ..... A45C 5/14 190/18 A
5,772,066 A * 6/1998 Reynolds ..... A45C 7/0063 220/23.83
5,799,851 A * 9/1998 Wulf ..... A45C 7/0045 224/580
5,803,333 A * 9/1998 Fawcett ..... A45F 3/00 224/148.2

(Continued)

*Primary Examiner* — Justin M Larson
(74) *Attorney, Agent, or Firm* — Durham Jones & Pinegar, P.C., Intellectual Propery Law Group

(57) ABSTRACT

A backpack, or carrying bag capable of carrying multiple items in a variety of configurations and capable of being carried in a plurality of ways. The backpack may include modular panels that are interchangeable within the main pocket of the backpack. The backpack may have shoulder straps as well as hand straps. The shoulder straps may be restrained or "hidden" within or behind a panel on the back of the backpack. The hand straps may be positioned on lateral sides of the backpack or the top of the backpack to carry the backpack like a briefcase. An expandable pocket may be positioned on either lateral side of the backpack and may be automatically retractable when not in. The backpack may also be entirely expandable to create more space in the central pocket with a perimeter zipper that creates more volume within the body of the backpack.

23 Claims, 8 Drawing Sheets

(56) References Cited

U.S. PATENT DOCUMENTS 5,845,780 A * 12/1998 Allen ..... A45C 3/00 206/579
5,984,154 A * 11/1999 Scicluna ..... A45F 3/04 190/18 A
6,053,382 A * 4/2000 Wyant ..... A45C 7/0068 190/103
6,135,334 A * 10/2000 Seichter ..... A45F 3/04 224/250
6,279,706 B1 * 8/2001 Mao ..... A45C 5/14 16/113.1
6,530,507 B2 * 3/2003 Oh ..... A45C 5/14 190/18 A
6,659,320 B1 * 12/2003 Alves ..... A45C 7/0086 224/581
6,726,075 B1 * 4/2004 Patel ..... A45F 3/14 224/582
6,742,684 B2 * 6/2004 Oh ..... A45C 9/00 224/153
6,923,352 B2 * 8/2005 Oh ..... A45C 5/14 190/1
7,111,731 B2 * 9/2006 Pratt ..... A45C 5/06 150/117
7,600,619 B2 * 10/2009 Sapyta ..... A45C 7/0054 190/107
7,617,917 B2 11/2009 Hai et al.
7,837,032 B2 * 11/2010 Smeltzer ..... A63B 55/00 206/315.5
8,292,136 B2 * 10/2012 Tonelli ..... A45C 13/38 224/250
9,854,887 B2 * 1/2018 Yu ..... A45C 9/00
10,278,463 B2 * 5/2019 Osnowitz ..... A45C 7/0077
2006/0269172 A1 11/2006 Godshaw et al.
2006/0283906 A1 * 12/2006 Laughton ..... A45C 11/38 224/583
2007/0017947 A1 * 1/2007 Fenton ..... A45C 7/0063 224/650
2007/0058887 A1 * 3/2007 Godshaw ..... A45C 13/00 383/104
2007/0125815 A1 * 6/2007 Tong ..... A45C 5/14 224/153
2007/0193902 A1 * 8/2007 Myers ..... A45C 13/1069 206/320
2007/0214613 A1 * 9/2007 Shiao ..... A63B 55/00 24/303
2008/0116697 A1 * 5/2008 D'Ambrosio ..... A45C 13/1069 292/251.5
2008/0236611 A1 10/2008 Redzisz et al.
2009/0057179 A1 * 3/2009 Smeltzer ..... A63B 55/00 206/315.5
2013/0182976 A1 * 7/2013 Ashley ..... A45C 7/0077 383/40
2018/0352923 A1 * 12/2018 Richards ..... A45C 9/00
2019/0059538 A1 * 2/2019 Osnowitz ..... A45C 7/0077

* cited by examiner

BACKPACK

CROSS-REFERENCE TO RELATED APPLICATION

This application incorporates the following patent application, in its entirety, by reference: U.S. patent application Ser. No. 15/621,849 entitled TRAVEL BAG and filed on Jun. 13, 2017.

FIELD

This disclosure relates generally to a backpack for carrying items and, more specifically, a backpack that may easily transition to a briefcase or briefcase type hand carry bag. The backpack may be expandable, modular and allow for easy transition between two configurations, a backpack, or a hand carry bag.

RELATED ART

Many different types of bags are used for work, school, and travel or simply for carrying items. Many of these bags include backpacks, duffle bags, travel bags, briefcases, shoulder bags and others. Most of these bags include straps and/or handles for a user to easily carry the bag. Some of these bags have straps you carry over one shoulder or both shoulder or straps or handles that allow you to carry the bag with your hands. The straps of these bags are generally secured to bag. Other instances of travel bags use wheels and handles to allow for easy movement while transporting the bag, such as walking through airports or to and from any destination.

Backpacks are also well known bags used for carrying items and are often used for travel purposes as well. In many cases, backpacks are used in the professional environment, or school environment, to carry documents, laptops and other important things. Briefcases or shoulder bags are also commonly utilized for the same or similar purpose of carrying useful and important items. In some instances, bags will include shoulder straps for a user to place the bag on his back but the bag is better suited as a duffle bag. In other cases backpacks may include a handle toward the top of the bag, or even to the side of the bag, that allow a user to hand carry the bag, instead of on a user's shoulders.

In yet other bags, a user may be able to easily carry the bag as a duffle bag in a user's hand or a user's shoulder or change the format of the straps and carry the bag as a backpack with two shoulder straps; however, in these instances, too often the transition between duffle bag to backpack requires changing the straps by unclipping and clipping the straps to different configurations. Other bags may use alternate straps all together to change from a hand carry bag to a backpack. Others may use other fasteners such as snaps or buttons to change the strap configuration, which makes the transition from a hand carry bag to a backpack difficult and tedious. Too often a user will only utilize a single function of the bag because it's too difficult to change the strap configuration.

This disclosure provided herein solves the strap configuration problem allowing a user to use a backpack or hand carry bag and easily transition from one to the other. In other terms, the following disclosure allows a user to easily utilize the backpack as a backpack or a hand carry bag with easy motion, without additional straps or securing features, and lets the user transition quickly and effectively without fumbling with the bag or the straps.

SUMMARY

This disclosure, in at least one aspect, relates to a bag which is multifunctional and more specifically, a backpack that may also function as a hand carry bag for both professional and recreational use. More generally, a device, or bag system, that provides easy transition from a backpack bag (or shoulder carry bag) to a hand carry bag (or briefcase bag).

The device may include a set of straps, anchored in at least two positions on the bag. The bag may include openings, pockets, sleeves, etc. ("pockets") for carrying a user's items. The pockets may be different shapes and sizes and in different configurations to maximize utilization space for the bag. Certain pockets may be configured to selectively fit certain items a user desires while traveling, commuting or simply moving.

The straps, or set of straps, may be anchored on the exterior of the bag in such a manner to allow a user to lift and carry the bag in a substantially balanced format. The straps may be anchored at one position toward a top of the bag and another position toward a bottom of the bag. One set of straps may be substantially on one lateral side of the bag and another set of straps on the opposite lateral side of the bag.

In a first position, the straps may be positioned behind a panel that may include flaps, flanges or wings that hold the straps in place between the panel and the back surface of the bag. The flaps may each extend laterally in opposite directions from a midline of the bag and include a securement feature, such as snaps or buttons, on the lateral end that interact with a complimentary feature on the back surface of the bag.

In a second position, the straps may be pulled out from behind the panel, by either pulling the straps themselves or by undoing the securement feature. The straps may be pulled and adjusted so that a user may place the straps on his or her shoulders and carry the bag as a backpack.

The transition from hand carry bag to backpack or from backpack to hand carry bag is as simple as placing the straps in front of or behind the panel. The straps may easily reside between the panel and the back surface of the bag without fumbling with the straps. The straps may also be adjusted by a user for a more snug fit as a backpack and easier placement between the panel and back surface of the bag.

The bag may also include multiple pockets and modular interior inserts. Interchangeable internal panels to allow user to vary the configuration may utilize VELCRO® or similar materials to secure the different inserts into the bag. In addition, the exterior of the bag may collapse and expand to allow a user to include more items within the bag if desired. Furthermore, the bag may also include a collapsible pocket or compartment that magnetically collapses the pocket to lay flush with the perimeter of the bag. The collapsible pocket may be on the interior or exterior of the bag. Numerous other functional pockets, zippers, channels, openings, passthroughs and other elements will become evident herein.

BRIEF DESCRIPTION OF THE DRAWINGS

These and other features, aspects, and advantages of the present disclosure are better understood when the following disclosure is read with reference to the accompanying drawings.

DETAILED DESCRIPTION

Figure 1:
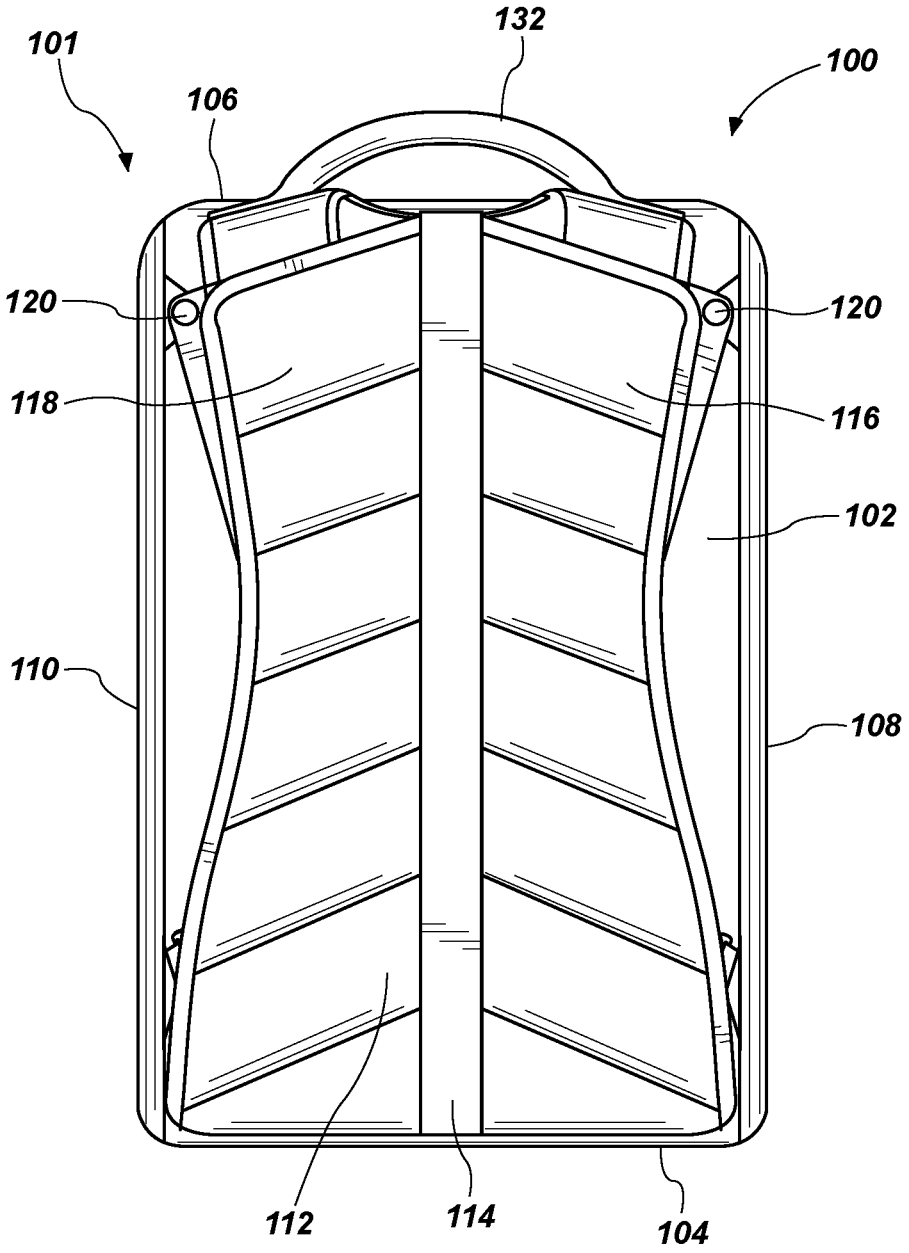
FIG. 1 is a back, or rear, view of a system, or bag, in a first configuration with straps secured behind a panel.

The following description sets forth a system, or bag, or handy carry bag, or briefcase, or backpack, or travel bag, or duffle bag, with a method for easy transition from a hand carry bag type bag to a backpack type bag. The system allows for an easy transition from one configuration to another configuration without the need of attaching or detaching straps. This system also includes elements and features for easy use by a user to access and store different items within the bag, such as laptops, water bottles, sunglasses, clothes, electronics, keys and more. A "first configuration" may be referred to as a hand carry bag, or briefcase, type configuration wherein a user may use the bag to carry in his or her hand by holding a single strap on the bag. A "second configuration" may be referred to as a backpack type configuration wherein a user may use the bag on his or her back with shoulder straps.

The following description sets forth separate embodiments and methods for utilizing the system and easy transition of the system from the first configuration to the second configuration as well as utilizing the bag and its functional elements. The strap or straps may be anchored to the bag in such a manner that the bag easily transforms from backpack to hand carry bag with a panel for securing or "hiding" the shoulder straps.

FIGS. 1-10 may be oriented according to the reference arrow diagram 10, having a superior direction 2 (toward a top of the bag), an inferior direction 4 (toward a bottom of the bag), a right lateral direction 6 (toward a right side of the bag), a left lateral direction 8 (toward a left side of the bag), a posterior direction 5 (toward a front of the bag), and an anterior direction 7 (toward a back of the bag). In this application, "left" and "right" are used with reference to a posterior view. "Medial" refers to a position or orientation toward a sagittal plane (i.e., plane of symmetry that separates left and right sides of the bag from each other), and "lateral" refers to a position or orientation relatively further from the sagittal plane.

It will be appreciated that although this disclosure refers to "panels" or "surfaces," that each of those panels or surfaces may be integrated and part of the other panel or surface, and the entire system, or bag, may be constructed out of a single piece of material with no seams or stops or starts. Alternatively, the system, or bag, may be made up of multiple pieces of material secured together via sewing, welding, ultrasonic welding, laser welding, stamp heat welding, hot plate welding, gluing, taping, one piece woven, and other fabric joining techniques known by those having skill in the art.

Referring to FIG. 1 at least one embodiment of a system 100, or bag is depicted. The bag 100 may include a back surface 102, a bottom surface 104, a top surface 106, a right surface 108 and a left surface 110. The bag 100 may be comprised of a single piece of material or multiple pieces of material. The bag 100 may include a panel 112, or back support, or butterfly panel, or plate, separate from, but integrated with, the back surface 102. The panel 112 may be secured to the bag toward the bottom surface 104 or secured to the bottom surface 104 itself or along a bondline where the back surface 102 and bottom surface 104 intersect. A bonding strap 114 of the panel 112 may extend longitudinally from one end of the panel 112 near the bottom surface 104 to the other end of the panel 112 near the top surface 106. The bonding strap 114 may be central to the panel 112 and secured to the back surface 102 of the bag 100. The bonding strap 114 may be integrated into the back surface 102 by any means described previously herein for securing material together.

The bonding strap 114 may include a pass-through that may allow for access through the bonding strap 114 from one side either the first flap 116 to the second flap 118, or vice versa, to the other allowing for passage of a handle, strap or arm through the pass-through. For example, the pass-through may allow for the passage of a luggage handle to allow the bag 100 to rest on the luggage while securing the bag 100 around the luggage handle.

The panel 112 may include flaps, or wings, that extend laterally from the bonding strap 114. A first flap 116 may extend from the bonding strap 114 toward the right surface 108. A second flap 118 may extend from the bonding strap 114 toward the left surface 110. The flaps 116, 118 may be secured toward a lateral right end and a lateral left end, respectively, via snaps 120, buttons or other securing feature to hold the flaps 116, 118 to the back surface 102 of the bag 100.

The flaps 116, 118 may hold a set of straps 122, which may be shoulder straps, between the back surface 102 and the panel 112. Referring to FIG. 1, the bag 100 is in a first configuration 101 wherein the set of straps 122 are positioned, or held, between the back surface 102 and the panel 112 and secured via snaps 120. The set of straps 122 are engaged to the bag 100 at positions toward the top surface 106 and the bottom surface 104.

Figure 2:
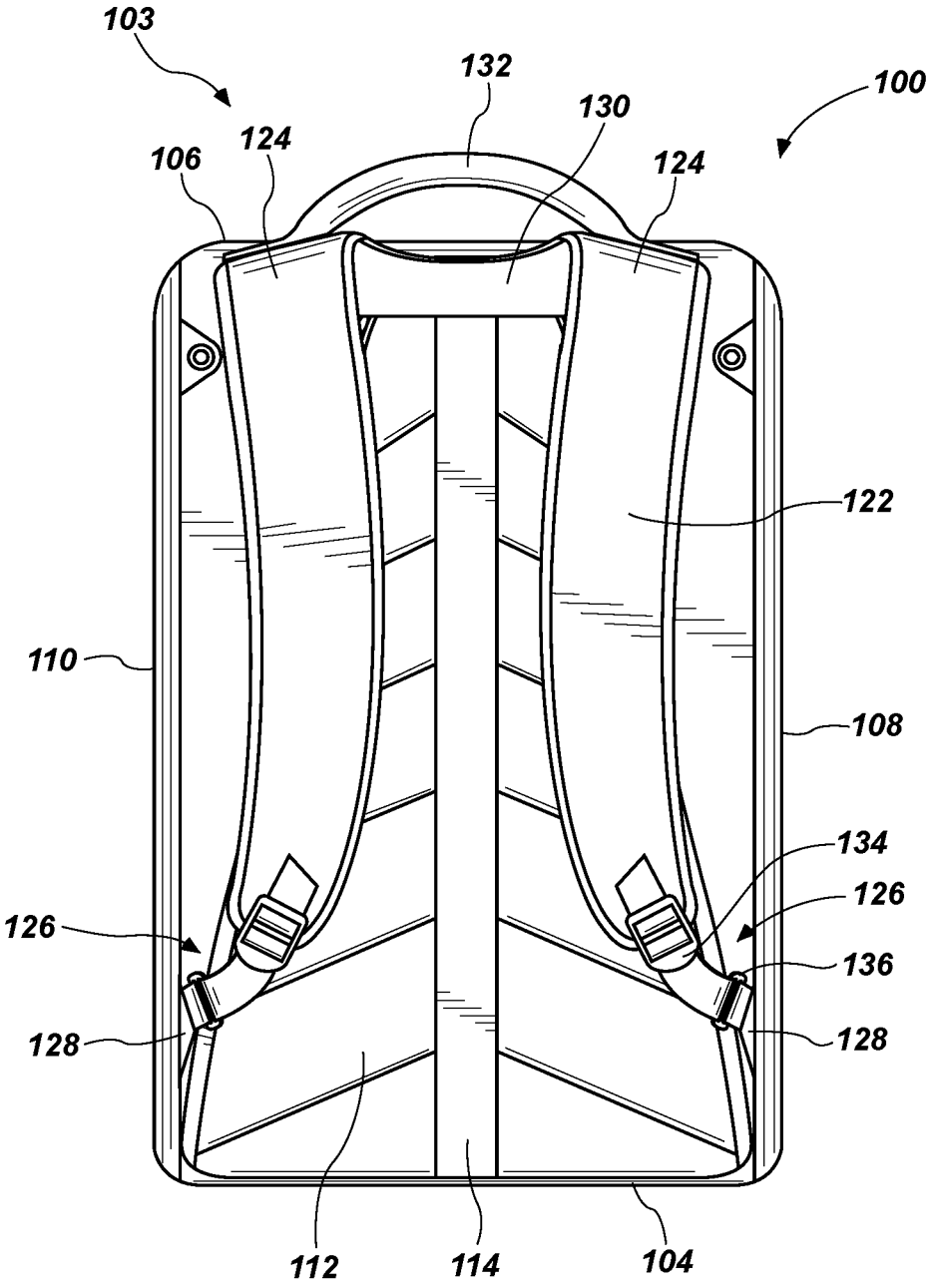
FIG. 2 is a back, or rear, view of the system, or bag, of FIG. 1 in a second configuration with the straps exposed from behind the panel.

Referring to FIG. 2, the bag 100 is depicted in a second configuration 103. The first end 124 of the set of straps 122 may be secured at a seam or bond line between the top surface 106 and the back surface 102. The second ends 126 of the set of straps 122 toward the bottom may actually be secured at a bond line or seam between the right surface 108 and back surface 102, and the bond line or seam between the left surface 110 and back surface 102, respectively. Anchors 128 may be substantially triangular in shape and engage the second ends 126 of the set of straps 122 on a side separate from the side of the anchor that is secured to the bag 100. The anchors 128, or sutures, may be secured to the bag by sewing, welding, ultrasonic welding, laser welding, stamp heat welding, hot plate welding, gluing, taping, one piece woven, and other fabric joining techniques known by those having skill in the art.

In this embodiment, the set of straps 122 may join to form one large strap or an intersection point 130 toward the first end 124 of the set of straps 122 and prior to engaging the bag 100. The set of straps 122 includes two second ends 126 that also engage the bag 100 on lateral sides of the bag 100 toward the right surface 108 and left surface 110. The second ends 126 may engage the bag 100 toward the bottom surface 104, but on the right and left sides respectively. Alternatively the second ends 126 may engage the bag 100 where the back surface 102 and the right surface 108 intersect and where the back surface 102 and left surface 110 intersect.

A top handle 132 may protrude from the top surface 106 allowing a user to carry the bag 100 in the first configuration 101 like a hand carry bag, or briefcase, or duffle bag or other similar bag. The top handle 132 may be malleable or it may be rigid. Alternatively, the top handle 132 may extend from the set of straps 122 positioned toward the first end 124 of the straps 122 rather than from the top surface 106 of the backpack 100. The top handle 132 may extend superiorly from the body of the bag 100.

The top handle 132 may sit flush with any of the surfaces of the backpack 100 and extend when pulled on by a user. The top handle 132 may extend from the set of straps 122 toward the first end 124 of the straps 122 rather than from the top surface 106 of the backpack 100.

To expose the set of straps 122, a user can disengage the snaps 120 from the back surface 102 of the bag 100 allowing the flaps 116, 118 to be manipulated (e.g. bending, rolling, sliding, folding, etc.). Manipulating the flaps 116, 118 allow a user to pull the set of straps 122 from behind the flaps 116, 118 exposing the set of straps 122. The set of straps 122 may resemble backpack straps and may be larger and padded toward the first end 124 of set the straps 122 and smaller and less padded (or not padded at all) toward the second ends 126 of the set of straps 122 and may simply be webbing or nylon straps. The set of straps 122 may be two separate portions wherein the first end 124 is a padded material resembling that of the bag 100 and may be integrated with the bag 100. The second ends 126 may be webbing, nylon or the like that is secured to the first end 124 via any means previously disclosed herein. The second ends 126 may also comprise adjustable clips 134 that allow a user to cinch the straps to a tighter configuration or loosen for a looser configuration. The second ends 126 of the straps 122 may engage other clips 136 and anchors 128 that may include looped material passing (similar to the webbing or nylon of the second ends 126 of the set of straps 122) through apertures in the clips 136 with the second ends 126 passing through apertures in the clips 136 as well and being secured via the adjustable clips 134.

The snaps 120 may be engaged again after the set of straps 122 are exposed and the set of straps 122 may be positioned, or reside, outside of the panel 112, allowing a user to carry the bag 100 like a backpack.

Figure 3:
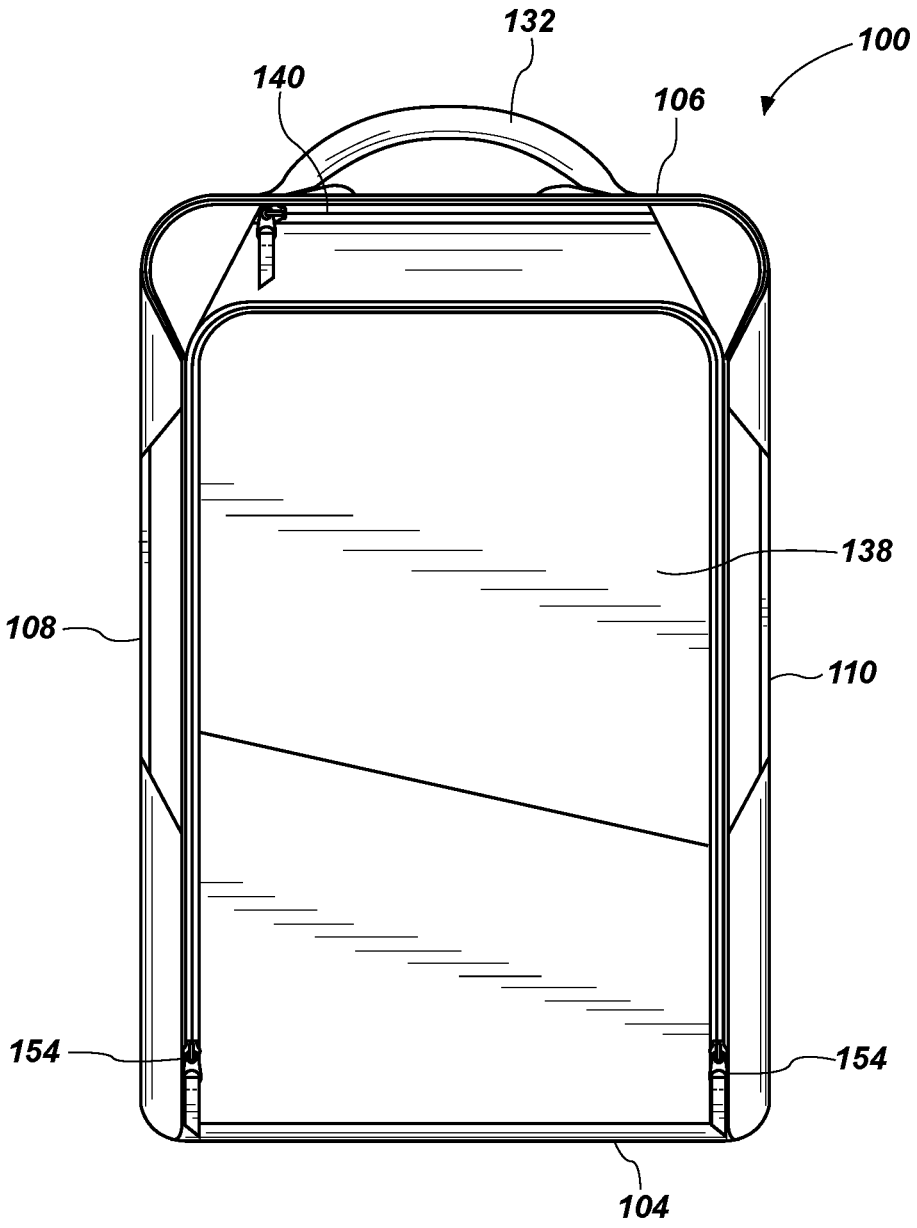
FIG. 3 is a front view of the system, or bag, of FIG. 1 with numerous pockets or openings with closure elements, or zippers.
Figure 10:
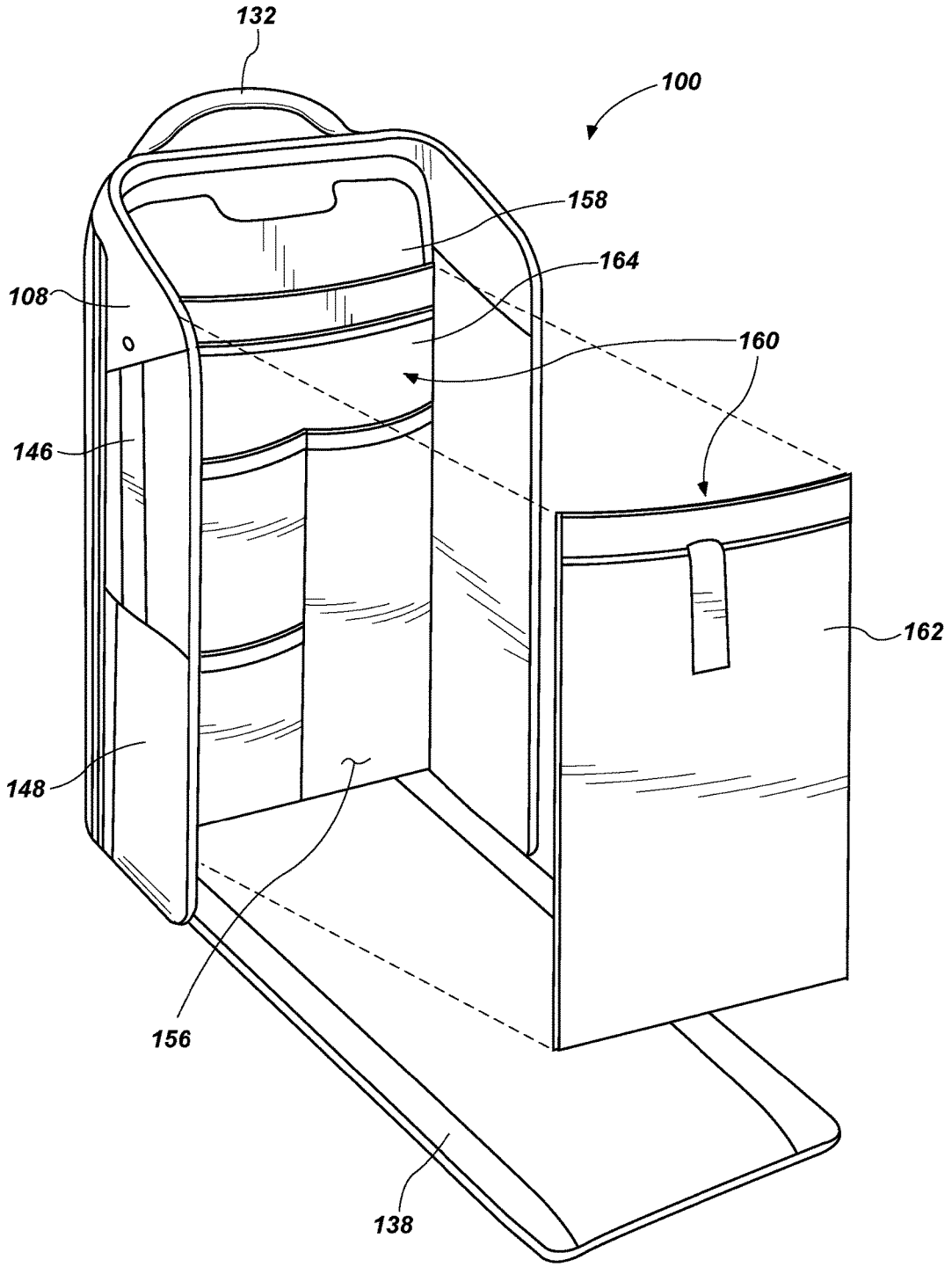
FIG. 10 is a front perspective view of the bag of FIG. 1 with the front pocket opened to expose an interior of the bag with a modular insert, or modular panel, exploded, or withdrawn, from an interior wall of the bag.

Referring to FIG. 3, the front of the bag 100 may include a front panel 138 that may include multiple access points to a central interior portion (see FIG. 10). The front panel 138 may be connected to the bag via a zipper 154 that may extend along three (3) sides of the front panel 138. The zipper or zippers 154 may allow you to open only a portion of the front panel 138 such that you can access the central interior portion from a top, left or right side, while keeping one or both of the other sides closed. Additional pockets may be accessible from the front of the bag 100, or the top portion 106 or the side portions 108, 110. A top pocket 140 may be biased toward the top portion 106 and may be lined with a soft microfiber or fleece material, or other soft material, so as not to scratch items which may be placed inside the top pocket 140.

Figure 4:
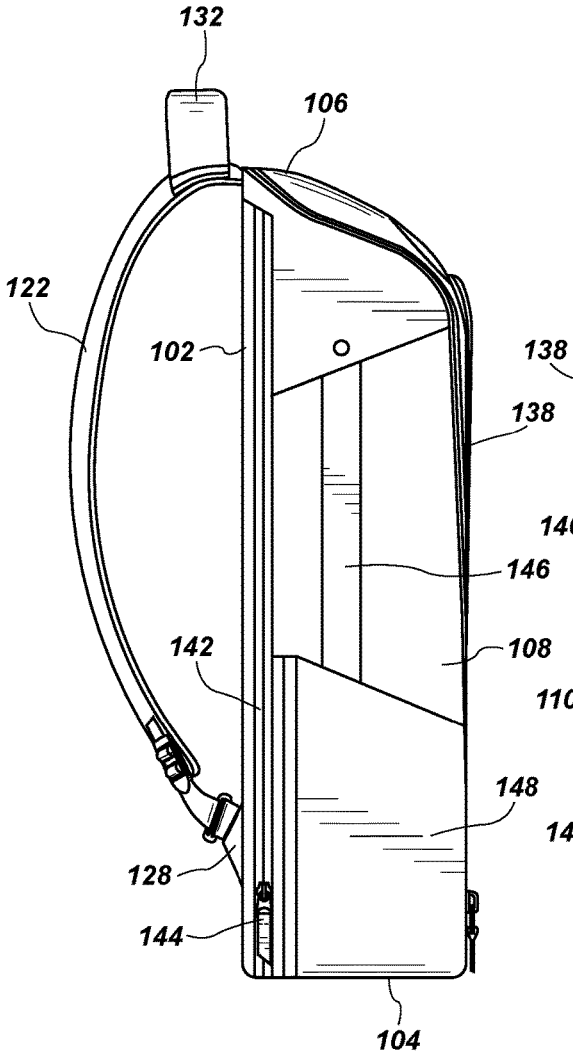
FIG. 4 is a first side view, or right side, of the bag of FIG. 1 with a side handle and the bag in a second configuration with the straps exposed.
Figure 5:
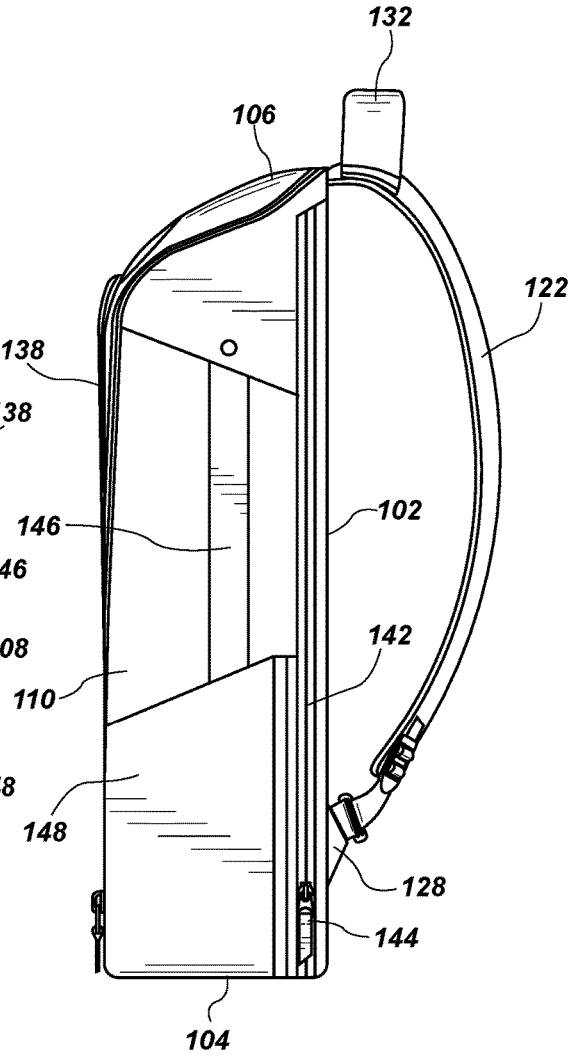
FIG. 5 is a second side view, or left side, of the bag of FIG. 1 with a side handle and the bag in a second configuration with the straps exposed.

Referring to FIGS. 4 and 5, the bag 100 may include an expansion element 142 which may be exposed by a zipper 144 that is biased toward the posterior direction 5 of the bag 100. The zipper 144 may expose or hid the expansion element 142, which may be extra material of the bag 100 itself that is collapsible or foldable behind or within the zipper 144. The expansion element 142 may expand as far as there is extra material and may vary from 1 cm to 8 cm. The expansion element 142 may run the entire perimeter of the bag 100, increasing the volume of the bag from its not expanded state. The expansion element 142 may only run a portion of the perimeter of the bag 100, for example from a halfway point on a right side 108 (or left side 110) from the inferior direction 4 of the bag 100 to the bottom surface 104 to another halfway point on the left side 110 (or the right side 108) from the inferior direction 4 of the bag 100. Alternatively, the expansion element 142 may run from the top surface 106 of the right side 108 to the top surface 106 of the left side 110 (or vice versa). While "halfway" has been described, it will be appreciated that the zipper 144 may include starts and stops at any position along the perimeter of the bag 100 to allow for expansion of the bag 100 to create greater volume.

A lateral handle 146 may be positioned on either the right side 108 or the left side 110, or both sides, of the bag 100. The lateral handle 146 may be comprised of strap-like material (i.e. mesh, nylon, etc.) that may reside flush or substantially flush with the side of the bag 100. The lateral handle 146 may include a retractable or elastic material such that when a user releases the handle 146 it returns to a flush-like state against the side of the bag 100. Alternatively, the lateral handle 146, may be more rigid material and may project from the side of the bag 100. Additionally, the lateral handle 146 may be combination of rigid material that is elastic or retractable so that it rests substantially flush with the side of the bag 100 when it is not being used or held by a user.

Figure 6:
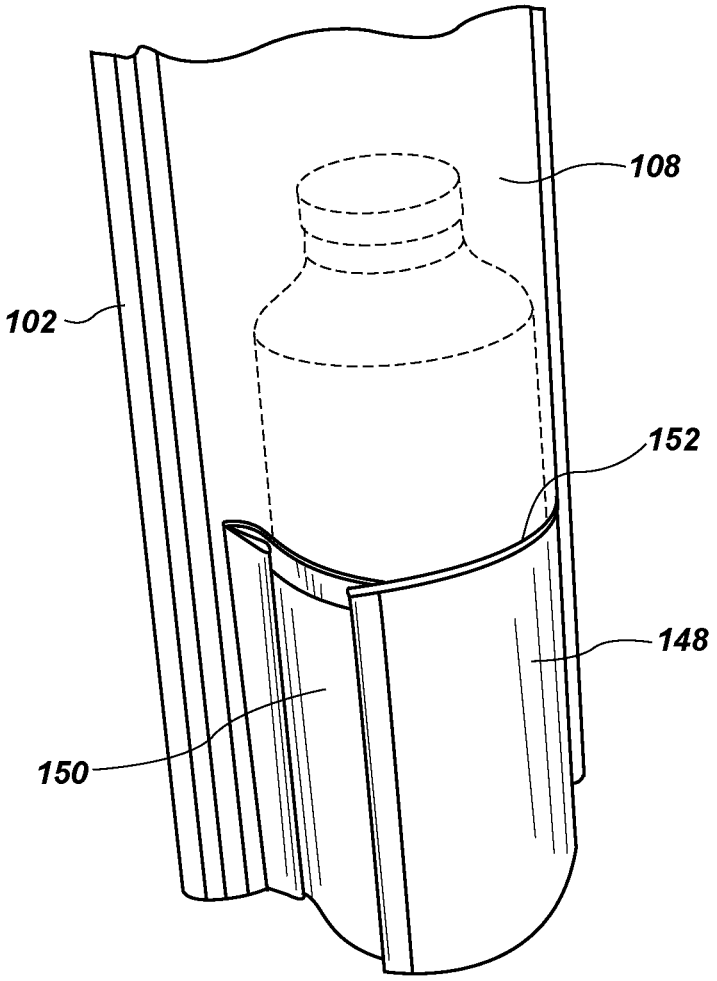
FIG. 6 is a magnified side view of the bag of FIG. 1 with a collapsible pocket in an open configuration.

Referring to FIG. 6, a pocket 148, or exterior pocket, or lateral pocket, may be positioned on either the right side 108 or left side 110, or both. The pocket 148 may be collapsible and may reside flush, or substantially flush, with the side of the bag 100. The pocket 148 may be configured to hold a water bottle or other similar items and may be open on one end of the pocket 148. The pocket 148 may be secured to the bag 100 on three of the exterior pocket's sides, toward the inferior of the bag, the posterior of the bag and the anterior of the bag. The opening 152 of the pocket 148 may be at a top, or superior end, of the pocket 148.

Expansion of the pocket 148 may occur in a lateral direction away from the side of the bag 100. The pocket 148 may include additional material that allows the pocket 148 to expand away from the side of the bag 100. The additional material may collapse within the pocket 148 when an item is removed from the pocket 148. The pocket 148 may collapse with the help of magnets residing in a portion of the pocket 148 that are biased toward one of the sides of the pocket 148, for example the anterior portion of the pocket 148 that is secured to the bag 100. Complementary magnets (polar opposites) may be positioned within the side of the bag 100 or within the seam where the pocket 148 is secured to the bag 100, such that a user may use some amount of frictional force to expand the pocket 148 away from the bag 100. Alternatively, a metal piece may reside within the bag 100 to attract the magnets as well, or alternative to complementary magnets. The pocket 148 is continually pulling itself closed because of the polarity of the magnets allowing a user to easily secure an item within the pocket 148.

Figure 7:
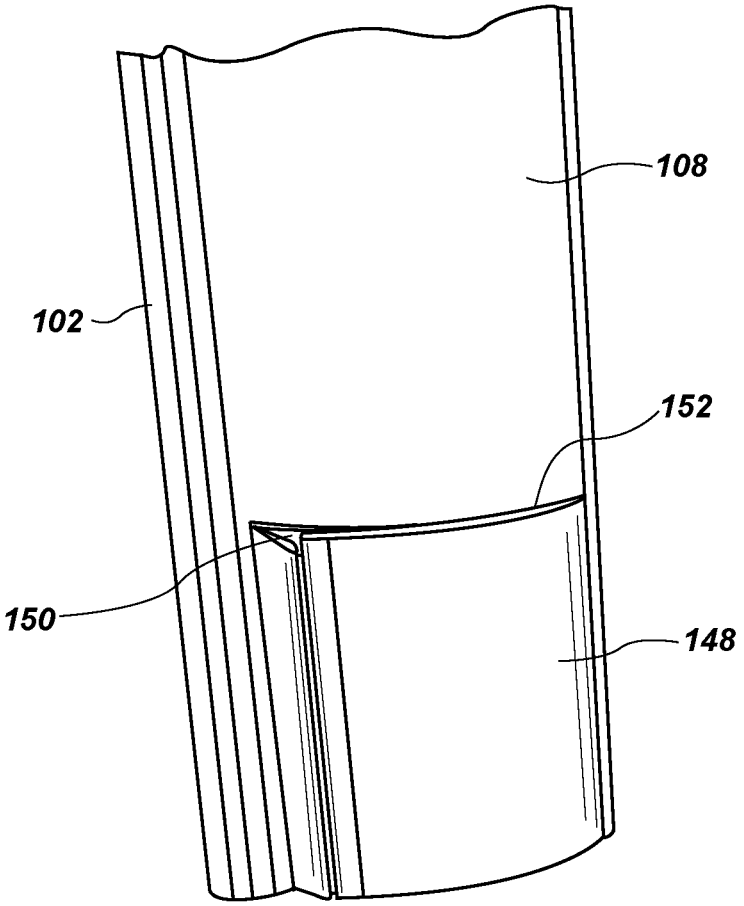
FIG. 7 is a magnified side view of the collapsible pocket of FIG. 6 with the pocket in a closed configuration.

Referring to FIG. 7, the pocket 148 may be in a resting or closed position. When the pocket 148 is empty because of the magnets positioning and configuration, the pocket 148 automatically retracts to a closed or flush, or substantially flush, position against the bag 100. Allowing the pocket 148 to automatically retract provides a user with less risk of the pocket 148 getting caught or snagging on something. The pocket 148, when not in use, and retracted, also decreases an overall footprint of the bag 100.

With regard to FIG. 6, the image may depict the pocket 148 positioned on the right surface 108, or right side, of the bag 100 with a collapsible portion 150 at least partially positioned toward the back surface 102, or back, of the bag 100. Alternatively or additionally, the pocket 148 may be positioned on the left surface 110, or left side, of the bag 100 with the collapsible portion 150 at least partially positioned, or biased, toward a back surface 102, or back, of the bag 100. The position of the collapsible portion 150 may determine the position of the magnets to collapse the pocket 148. It will be appreciated that the collapsible portion 150 may bet alternatively collapsible toward the front panel 138 of the bag 100 instead of the back surface 102 by, essentially, "flipping" the pocket 148 during manufacture.

The pocket 148 may also collapse with manual pressure and be secured by means other than magnets, for example, snaps, buttons, Velcro® or the like. This feature allows the pocket 148 to sit flush with one of the sides 108, 110 of the bag. The excess material that may be provided at the inferior portion, or base, of the pocket 148 and the collapsible portion 150 may retract within the pocket 148 itself when the pocket 148 is not in use. The excess material for the pocket 148 may be a nylon or other easily flexible, collapsible and durable material.

Figure 8:
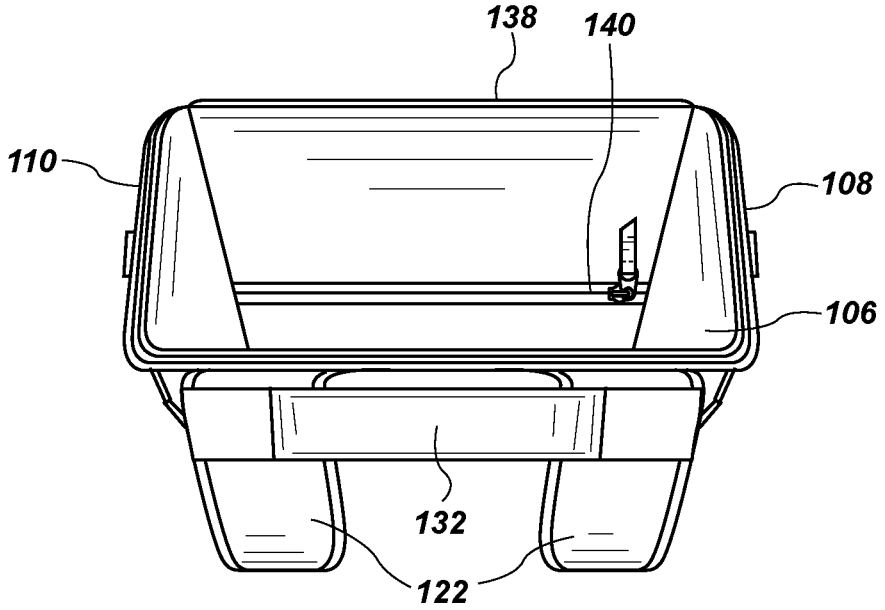
FIG. 8 is a top view of the bag of FIG. 1 with a top surface, at least one top pocket and the bag in a second configuration with the straps exposed.

Referring to FIG. 8, the top surface 106 may include the top pocket 140 that may open and close with a zipper or other means to close the top pocket 140. In addition, in this embodiment, the top handle 132 extends from the straps 122 rather than the top portion 106 of the bag 100.

Figure 9:
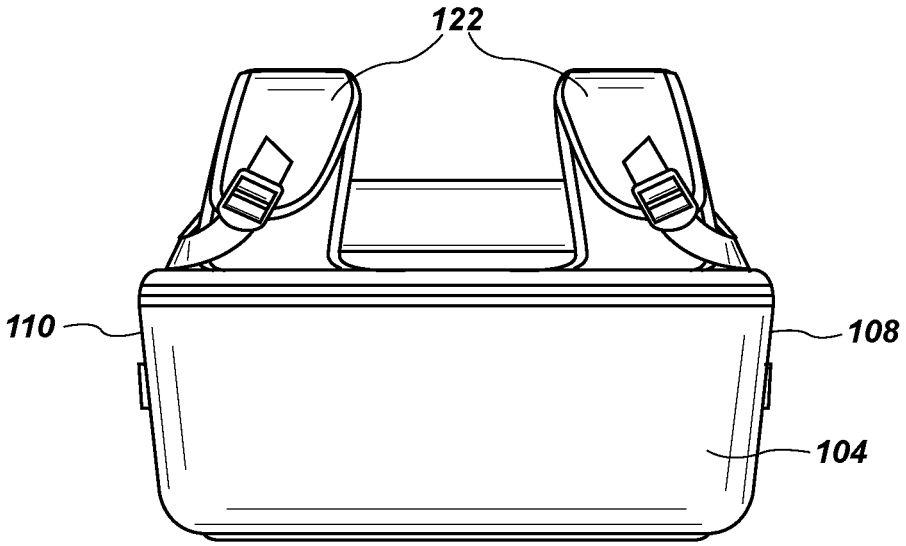
FIG. 9 is a bottom view of the bag of FIG. 1 with a bottom surface and the bag in a second configuration with the straps exposed.

Referring to FIG. 9, the bottom surface 104 may be substantially planar, or flat. The bottom surface 104 may be rigid or substantially rigid such that the bag 100 may stand up without any lateral support with the bottom surface engaging the ground. The bottom surface 104 allows the bag 100 to stand up straight without falling over or tipping over.

Referring to FIG. 10, the central interior portion 156, which may be a void, or large void internal to the bag 100, is exposed as the front panel 138 is unzipped from the three sides of the bag 100. The front panel 138 may be configured to be able to lay flat because of the ability for three of its sides to be unsecured to the bag 100 itself. The central interior portion 156 is modular in that it may be configured in a plurality of configurations. The central interior portion 156 may include an interior wall 158. The interior wall 158 may include a Velcro® exterior surface that allow for a plurality of interchangeable panels 160 to be secured to the interior wall 158. The interchangeable panels 160 may include a complementary Velcro® portion that engages the interior wall 158. Each of the interchangeable panels 160 may vary depending on a user's preference. One of the plurality of interchangeable panels 160 may include a single large pocket panel 162 that allows for storage of papers, folders or other similar items. Another of the plurality interchangeable panels may include a "tech" pocket panel 164 that may allow for storage of technological items, such as a keyboard, a mouse, charging cables, phones, tablets, laptops and other cables and accessories. Another of the plurality of interchangeable panels 160 may be an expandable pocket that allows for placement and storage of clothing items or shoes or the like, or bulkier items that may not fit in the other panels 162, 164. It will be appreciated that multiple configurations may be utilized for the plurality of panels 160 that may engage the interior portion 156 of the bag 100 and those configurations are contemplated herein.

A separate compartment 166, or pocket, may be positioned just behind the interior wall 158. The compartment 166 may be configured to hold a laptop or other similar item. The compartment 166 may be surrounded by shock absorption material or pliable material, such as foam or the like, to prevent damage to the items stored within the compartment 166.

Alternatively, the front panel 138 may include pockets as well that may allow for storage of items such as tablets and laptops and may be surrounded by similar foam as described herein. The alternative embodiment of the bag 100 may also include a mesh dividing wall that may be accessed via a zipper, or other securing means such as snaps, buttons, Velcro®, or the like. The mesh dividing wall may be used to store items in front of or behind the mesh dividing wall such as clothing and shoes.

The straps 122 described herein may be comprised of any suitable, durable material, such as nylon, webbing or other fabrics well known for bags and backpacks, duffle bag, travel bags, or the like. The bag 100 may be comprised of any fabric or material typical for bags and travel bags which may include nylon including other waterproof materials.

While the above disclosure utilizes multiple straps it is considered and contemplated that the system 100 or bag could function similarly with a single strap (e.g. like a cross body single strap backpack). Furthermore, while the present embodiment depicts one or more embodiments for a backpack or travel bag, alternatives are contemplated herein specifically with regard to dimensions and materials and are considered part of this disclosure.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A carrying bag system comprising:

a set of straps extending from a top of the bag toward a bottom of the bag;

at least one opening;

and a panel positioned on a back portion of the bag and configured to hold the set of straps, the panel comprising: a bond line securing the panel to the bag; a first flap extending laterally from the bond line; a second flap extending laterally from the bond line in the opposite direction as the first flap; and a first engagement feature positioned on each of the lateral ends of the first and second flaps; and a second engagement feature complementary to and positioned on the bag opposite the first engagement feature configured to secure lateral ends of the first and second flaps to the bag.

2. The system of claim 1 comprising:

a first configuration wherein the set of straps is positioned inside, between the panel and the back portion of the bag; and a second configuration wherein the set of straps is positioned outside of the panel and the back portion of the bag.

3. The system of claim 1 comprising:

a front panel reversibly engaged to the bag on three sides, wherein the front panel disengages the bag to provide the at least one opening, wherein the at least opening provides access to an internal portion of the bag, wherein the internal portion of the bag is modular, wherein the internal portion comprises a void.

4. The system of claim 3 wherein the internal portion further comprising:

a first wall with a planar engagement feature;

at least one panel configured to reversibly engage the first wall with a complementary planar engagement feature positioned on at least one side of the at least one panel.

5. The system of claim 1 comprising: an expansion element configured to increase the size of the bag; and at least one pocket positioned laterally and configured to expand when force is applied and retract when force is not applied.

6. The system of claim 5, wherein the lateral pocket comprises a first set of magnets positioned toward a first end of the lateral pocket and a second set of magnets positioned in the lateral side of the bag, complementary to the first set of magnets.

7. The system of claim 5, wherein the system comprises a first configuration when the lateral pocket is retracted and a second configuration when the lateral pocket is expanded.

8. The system of claim 5, wherein the expansion element is positioned at least partially along the perimeter of the bag.

9. A system comprising:

a backpack with at least one opening;

at first strap and a second strap, laterally displaced and separate from one another, each strap extending from a top portion of the backpack to a bottom portion of the backpack; and a panel extending from a back surface of the backpack, the panel comprising:

a first flap extending in one direction from a bond line of the panel; and a second flap extending in a second direction from the bond line of the panel; a first engagement feature positioned on each of the lateral ends of the first and second flaps; and a second engagement feature complementary to and positioned on the backpack opposite the first engagement feature configured to secure lateral ends of the first and second flaps to the backpack.

10. The system of claim 9 comprising:

at least one lateral pocket engaging a side of the backpack along a perimeter of the pocket along three sides of the pocket with an opening toward a top of the pocket.

11. The system of claim 10, wherein the pocket comprises magnets along at least one of the three sides engaging the backpack and the side of the backpack comprises magnets complementary placed within the side of the backpack so has to attract the magnets along the at least one of the three sides.

12. The system of claim 10 comprising:

a first configuration wherein the pocket is positioned in a closed configuration wherein the pocket is substantially flush with the side of the backpack.

13. The system of claim 10 comprising:

a second configuration wherein the pocket is positioned in an expanded configuration wherein the pocket is substantially open.

14. The system of claim 9 comprising: an expansion element configured to increase the size of the bag, wherein the expansion element is positioned at least partially along the perimeter of the bag.

15. The system of claim 9 comprising:

a first configuration wherein the first strap is positioned inside, between the first flap and the back portion of the backpack and the second strap is positioned inside, between the second flap and the back portion of the backpack; and a second configuration wherein the first strap and the second strap are positioned outside of the panel and the back portion of the bag.

16. The system of claim 9 comprising:

a front panel reversibly engaged to the bag on three sides, wherein the front panel disengages the backpack to provide the at least one opening, wherein the at least one opening provides access to an internal portion of the backpack, wherein the internal portion of the backpack is modular, wherein the internal portion comprises a void.

17. The system of claim 16 wherein the internal portion further comprises:

a first wall with a planar engagement feature;

at least one panel configured to reversibly engage the first wall with a complementary planar engagement feature positioned on at least one side of the at least one panel.

18. A backpack comprising:

an expandable pocket biased toward a side of the backpack, wherein the expandable pocket comprises;

a first set of magnets positioned toward a first end of the expandable pocket; and a second set of magnets positioned in a complementary position toward the side of the backpack;

wherein the system comprises a first configuration when the lateral pocket is substantially flush against the backpack; and a second configuration wherein the expandable pocket is substantially non-flush against the backpack; and a panel positioned on a back portion of the backpack and configured to hold the set of straps, the panel comprising: a bond line securing the panel to the backpack; a first flap extending laterally from the bond line; a second flap extending laterally from the bond line in the opposite direction as the first flap; and a first engagement feature positioned on each of the lateral ends of the first and second flaps; and a second engagement feature complementary to and positioned on the backpack opposite the first engagement feature configured to secure lateral ends of the first and second flaps to the backpack.

19. The backpack of claim 18 comprising:

a set of straps extending from a top of the backpack toward a bottom of the backpack;

and at least one central opening.

20. The backpack of claim 18 comprising an expansion element configured to increase the size of the backpack, wherein the expansion element is positioned along the perimeter of the bag.

21. The system of claim 18 comprising:

a first configuration wherein the set of straps is positioned inside, between the panel and the back portion of the backpack; and a second configuration wherein the set of straps is positioned outside of the panel and the back portion of the backpack.

22. The system of claim 18 comprising:

a front panel reversibly engaged to the bag on three sides, wherein the front panel disengages the backpack to provide at least one opening, wherein the at least opening provides access to an internal portion of the backpack, wherein the internal portion of the backpack is modular, wherein the internal portion comprises a void.

23. The system of claim 22 wherein the internal portion further comprising:

a first wall with a planar engagement feature;

at least one panel configured to reversibly engage the first wall with a complementary planar engagement feature positioned on at least one side of the at least one panel.

* * * * *